US009829218B2

(12) United States Patent
Xu

(10) Patent No.: US 9,829,218 B2
(45) Date of Patent: Nov. 28, 2017

(54) CRYOGENIC REFRIGERATOR

(71) Applicant: SUMITOMO HEAVY INDUSTRIES, LTD., Tokyo (JP)

(72) Inventor: Mingyao Xu, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 15/221,726

(22) Filed: Jul. 28, 2016

(65) Prior Publication Data

US 2016/0334144 A1 Nov. 17, 2016

Related U.S. Application Data

(62) Division of application No. 13/614,055, filed on Sep. 13, 2012, now abandoned.

(30) Foreign Application Priority Data

Sep. 28, 2011 (JP) ..... 2011-212239
May 24, 2012 (JP) ..... 2012-118332

(51) Int. Cl.
*F25B 9/14* (2006.01)
*F25B 31/00* (2006.01)

(52) U.S. Cl.
CPC ..... *F25B 9/14* (2013.01); *F25B 31/00* (2013.01); *F25B 2309/1406* (2013.01)

(58) Field of Classification Search
CPC . F25B 9/14; F25B 2309/003; F25B 2309/006
See application file for complete search history.

(56) References Cited

U.S. PATENT DOCUMENTS

| | | | | |
|---|---|---|---|---|
| 5,156,121 | A | 10/1992 | Routery | |
| 5,281,100 | A | 1/1994 | Diederich | |
| 5,361,588 | A | 11/1994 | Asami et al. | |
| 5,398,512 | A | 3/1995 | Inaguchi et al. | |
| 5,743,716 | A | 4/1998 | Smith | |
| 2011/0219810 | A1 * | 9/2011 | Longsworth | F25B 9/14 62/474 |

FOREIGN PATENT DOCUMENTS

| | | |
|---|---|---|
| JP | H01-167558 | 7/1989 |
| JP | H03-075456 | 3/1991 |
| JP | 2617681 | 6/1997 |
| JP | H10-089789 | 4/1998 |

* cited by examiner

*Primary Examiner* — Frantz Jules
*Assistant Examiner* — Brian King
(74) *Attorney, Agent, or Firm* — IPUSA, PLLC

(57) ABSTRACT

A cryogenic refrigerator includes a cylinder, a displacer configured to be moved back and forth in the cylinder by a drive unit, an inlet valve configured to be opened in supplying a refrigerant gas into the cylinder, an exhaust valve configured to be opened in exhausting the refrigerant gas from the cylinder, and an expansion space formed in the cylinder and configured to generate a cooling by expanding the refrigerant gas caused by back and forth movement of the displacer. A moving speed of the displacer in the vicinity of a bottom dead center is set to be faster than the moving speed of the displacer in the vicinity of a top dead center.

12 Claims, 12 Drawing Sheets

| | FIRST STAGE TEMPERATURE (K)44W | SECOND STAGE TEMPERATURE (K)1.0W |
|---|---|---|
| COMPARATIVE EXAMPLE | 46.2 | 4.26 |
| WORKING EXAMPLE | 45.1 | 4.19 |

CRYOGENIC REFRIGERATOR

CROSS-REFERENCE TO RELATED APPLICATIONS

This patent application is a divisional application of and is claiming benefit of priority under 35 U.S.C. 120 to U.S. patent application Ser. No. 13/614,055 filed on Sep. 13, 2012, which is based upon and claims the benefit of priority of Japanese Patent Application No. 2011-212239, filed on Sep. 28, 2011, and Japanese Patent Application No. 2012-118332 filed on May 24, 2012, the entire contents of which are incorporated herein by reference.

BACKGROUND OF THE INVENTION

1. Field of the Invention

The present invention relates to a cryogenic refrigerator, and more specifically to a cryogenic refrigerator including a displacer.

2. Description of the Related Art

Conventionally, a Gifford McMahon refrigerator (which is called hereinafter "GM refrigerator") is known as a cryogenic refrigerator including a displacer. This GM refrigerator is configured to allow the displacer to move back and forth in a cylinder by a drive unit.

Moreover, an expansion space is formed between the cylinder and the displacer. By allowing the displacer to move back and forth in the cylinder, a refrigerant gas that is supplied to the expansion space is expanded, so that a cryogenic cooling is generated.

In general, in this kind of GM refrigerator, a moving speed of one cycle in which the displacer moves back and forth at one stroke in the cylinder is set to be the same as a speed of a simple harmonic motion.

Generally speaking, the displacer is in the vicinity of the bottom dead center, and the GM refrigerator performs a process that suctions a high-pressure refrigerator gas into the cylinder.

SUMMARY OF THE INVENTION

According to an aspect of the present invention, there is provided a cryogenic refrigerator including a cylinder, a displacer configured to be moved back and forth in the cylinder by a drive unit, an inlet valve configured to be opened in supplying a refrigerant gas into the cylinder, an exhaust valve configured to be opened in exhausting the refrigerant gas from the cylinder, and an expansion space formed in the cylinder and configured to generate a cooling by expanding the refrigerant gas caused by back and forth movement of the displacer. A moving speed of the displacer in the vicinity of a bottom dead center is set to be faster than the moving speed of the displacer in the vicinity of a top dead center.

Additional objects and advantages of the embodiments are set forth in part in the description which follows, and in part will become obvious from the description, or may be learned by practice of the invention. The objects and advantages of the invention will be realized and attained by means of the elements and combinations particularly pointed out in the appended claims. It is to be understood that both the foregoing general description and the following detailed description are exemplary and explanatory and are not restrictive of the invention as claimed.

DETAILED DESCRIPTION OF THE PREFERRED EMBODIMENTS

According to the cryogenic refrigerator disclosed in Japanese Patent No. 2617681, when the moving speed of the displacer is set the same as the simple harmonic motion in one cycle, a pressure increase of the refrigerant gas in the expansion space is not enough because an inlet speed of the refrigerant gas into the expansion space is slow. Accordingly, there is a concern that not enough cooling can be generated in generating the cooling, and a cooling efficiency is decreased.

Embodiments of the present invention provide a novel and useful cryogenic refrigerator solving one or more of the problems discussed above.

More specifically, embodiments of the present invention provide a cryogenic refrigerator that can improve a cooling efficiency.

A description is given below, with reference to drawings of embodiments of the present invention.

Figure 1:
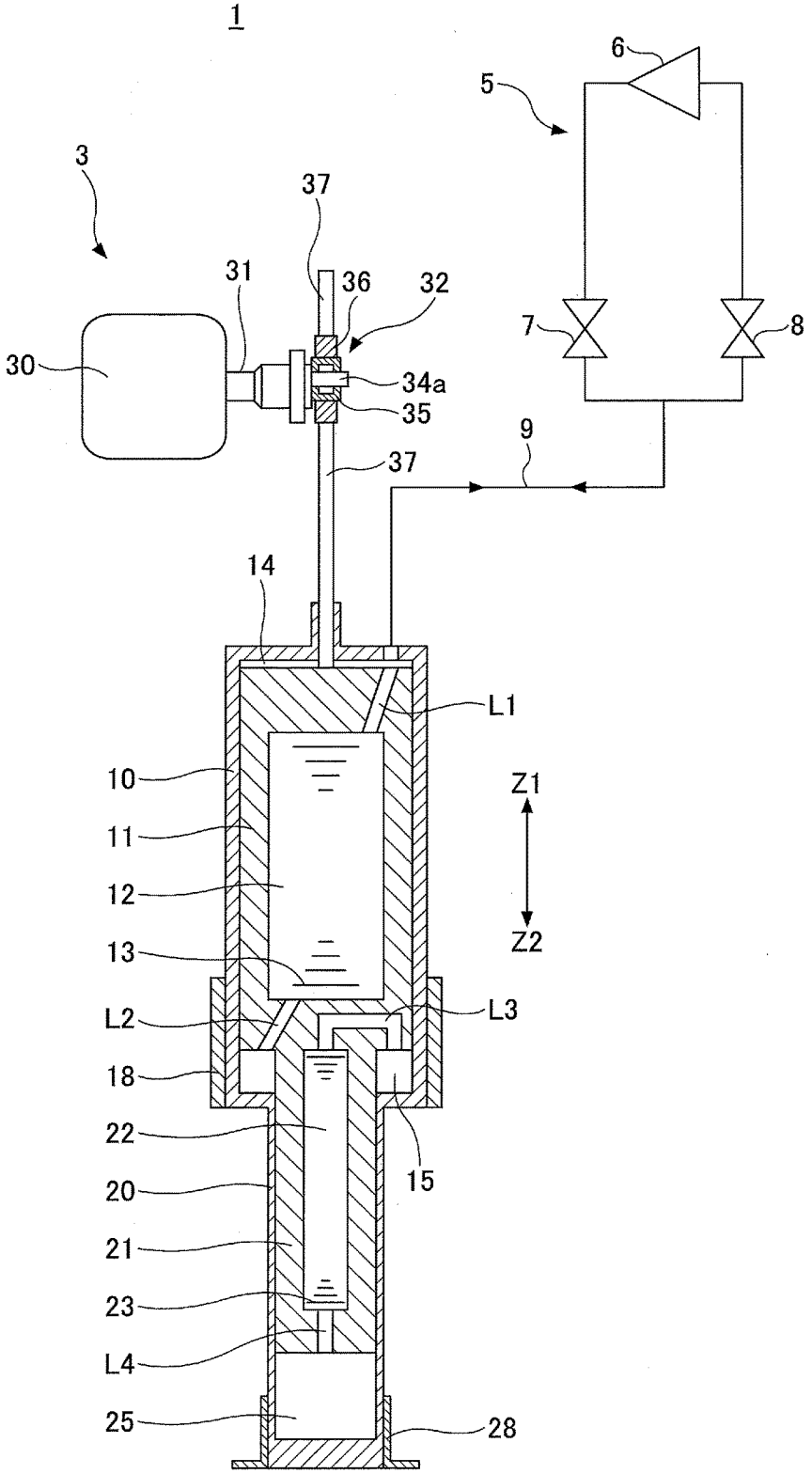
FIG. 1 is an outline configuration diagram of a GM refrigerator of a first embodiment of the present invention.

FIG. 1 shows a cryogenic refrigerator of a first embodiment of the present invention. In the following description, the cryogenic refrigerator using a Gifford McMahon cycle (which is hereinafter called "a GM refrigerator") is taken as an example and described thereof. However, application of the present invention is not limited to the GM refrigerator, but is possible for various cryogenic refrigerators using a displacer (e.g., a Solvay refrigerator, a Stirling refrigerator, and the like).

The GM refrigerator 1 of the present embodiment is a two-stage refrigerator, which includes a first-stage cylinder 10 and a second-stage cylinder 20. These first-stage cylinder 10 and second-stage cylinder 20 are formed of a stainless steel with a low thermal conductivity. Moreover, the high-temperature end of the second-stage cylinder 20 is configured to be coupled to the low-temperature end of the first-stage cylinder 10.

The second-stage cylinder 20 has a diameter smaller than that of the first-stage cylinder 10. A first-stage displacer 11 and a second-stage displacer 21 are respectively inserted into the first-stage cylinder 10 and the second-stage cylinder 20. The first-stage displacer 11 and the second-stage displacer 21 are coupled to each other, and are driven to move back and forth in an axial direction of the cylinders 10, 20 (i.e., arrows Z1, Z2 directions in the drawing) by a drive unit 3.

Furthermore, regenerators 12, 22 are respectively provided inside the first-stage displacer 11 and the second-stage displacer 21. The inside of the regenerators 12, 22 are respectively filled up with regenerator materials 13, 23. In addition, a space 14 is formed at the high-temperature end in the first-stage cylinder 10, and a first-stage expansion chamber 15 is formed at the low-temperature end. Moreover, a second-stage expansion chamber 25 is formed on the low-temperature side of the second-stage cylinder 20.

The first-stage displacer 11 and the second-stage displacer 21 include plural gas passages L1 through L4 to let through a refrigerant gas (e.g., helium gas). The gas passages L1 connects the space 14 to the regenerator 12, and the gas passage L2 connects the regenerator 12 to the first-stage expansion chamber 15. Furthermore, the gas passage L3 connects the first-stage expansion chamber 15 to the regenerator 22, and the gas passage L4 connects the regenerator 22 to the second-stage expansion chamber 25.

The space 14 on the high-temperature end side of the fist-stage cylinder is connected to a gas supply system 5. The gas supply system 5 is configured to include a gas compressor 6, valves 7, 8, a gas passage 9 and the like.

An inlet valve 7 is connected to the inlet port side of the gas compressor 6, and an exhaust valve 8 is connected to the exhaust port side of the compressor 6. When the inlet valve 7 is opened and the exhaust valve 8 is closed, the refrigerant gas is supplied from the gas compressor 6 into the space 14 through the inlet valve 7 and the gas passage 9. When the inlet valve 7 is closed and the exhaust valve 8 is opened, the refrigerant gas in the space 14 is recovered into the gas compressor 6 through the gas passage 9 and the exhaust valve 8.

Figure 2:
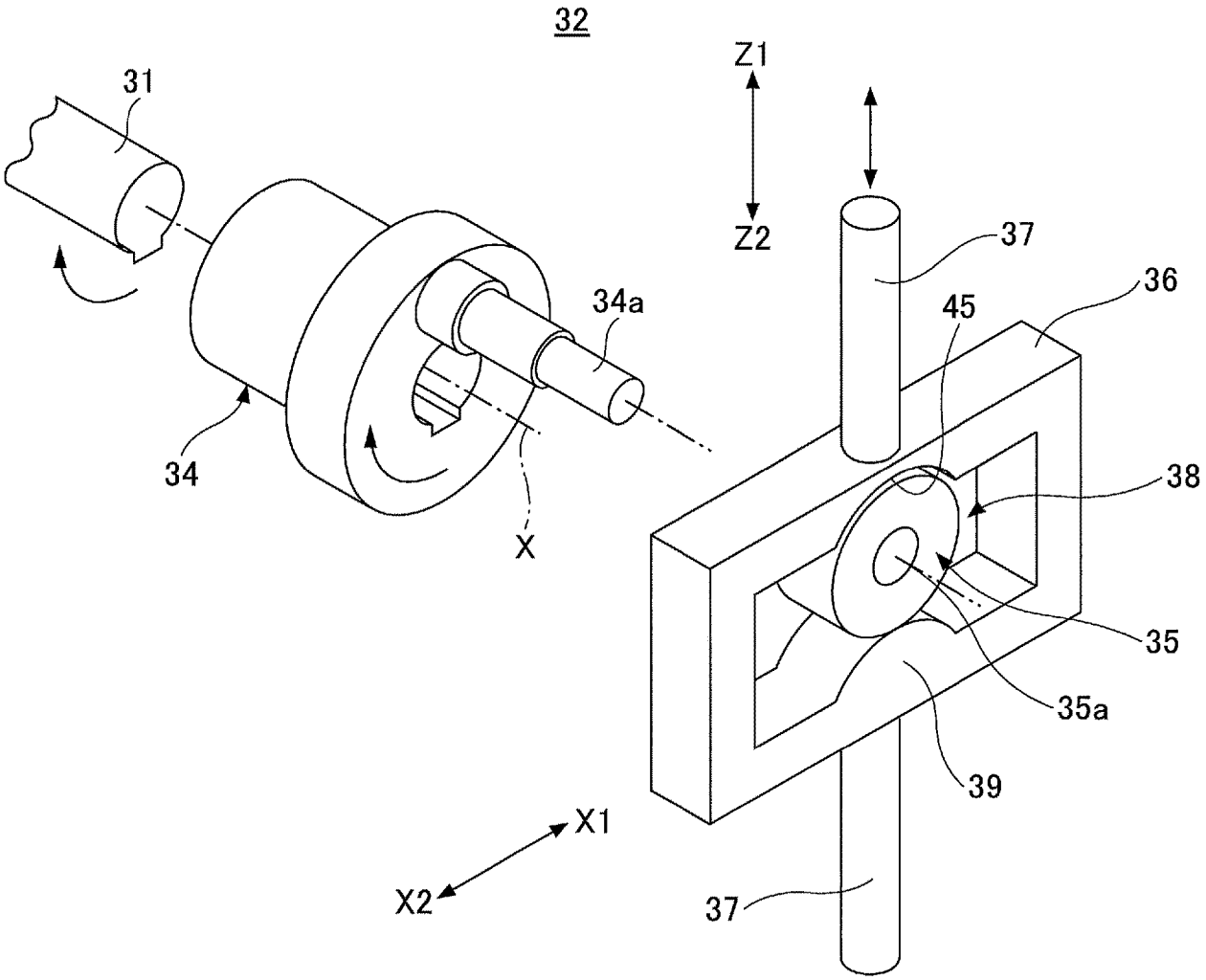
FIG. 2 is an exploded perspective diagram showing an enlarged Scotch-yoke mechanism provided at the GM refrigerator of the first embodiment of the present invention.

The drive unit 3 forces the first-stage and second-stage displacers 11, 21 to move back and forth in the first-stage and second-stage cylinders 10, 20. The drive unit 3 is constituted of a motor 30 and a Scotch-yoke mechanism 32. FIG. 2 shows the enlarged Scotch-yoke mechanism 32. The Scotch-yoke mechanism 32 is roughly constituted of a crank member 34 and a Scotch-yoke 36.

The crank member 34 is fixed to a rotational shaft (which is hereinafter called "a motor shaft 31"). The crank member 34 is configured to include a crank pin 34*a* provided at a location eccentric to a mounting position of the motor shaft 31. Hence, when the crank member 34 is mounted on the motor shaft 31, the motor shaft 31 and the crank pin 34*a* are eccentric to each other.

In addition, in the Scotch-yoke 36, a slide groove 38 is formed so as to extend in directions perpendicular to moving directions of the respective displacers 11, 21 (i.e., directions shown by arrows X1, X2). Accordingly, the Scotch-yoke 36 is formed in a frame shape.

The slide groove 38 formed into the Scotch-yoke 36 engages with a roller bearing 35. The roller bearing 35 is configured to be able to roll in the directions of arrows X1, X2 in the slide groove 38. Here for convenience of explanation, a description is given below about a specific configuration of the Scotch-yoke 36 and the slide groove 38.

A crank pin engagement hole 35*a* that engages with the crank pin 34*a* is formed at the center position of the roller bearing 35. Accordingly, when the motor shaft 31 is rotated in a state of the crank pin 34*a* engaged with the roller bearing 35, the crank pin 34*a* rotates so as to draw an arc, by which the Scotch-yoke 36 moves back and forth in directions of arrows Z1, Z2. At this time, the roller bearing 35 moves back and forth in the directions of the arrows X1, X2 in the slide groove 38.

The Scotch-yoke 36 is provided with drive arms 37 that extend out in the upward direction and the downward direction. The lower drive arm 37 of the drive arms 37 is coupled to the first-stage displacer 11 as shown in FIG. 1. Therefore, when the Scotch-yoke 36 moves in the Z1, Z2 directions by the Scotch-yoke mechanism 32 as discussed above, the drive arms 37 moves upward and downward, by which the first-stage and second-stage displacers 11, 21 are moved back and forth in the first-stage and second-stage cylinders 10, 20.

A drive of the inlet valve 7 and the exhaust valve 8 is controlled by a rotary valve (not shown in the drawing) driven by the motor 30. The rotary valve controls the drive so that open and close of the inlet valve 7 and the exhaust valve 8, and the back and forth motions of the respective displacers 11, 21 have a predetermined phase difference. This phase difference causes the refrigerant gas to expand in the first-stage expansion chamber 15 and the second-stage expansion chamber 25, which generates a cooling.

Next, a description is given about operation of the GM refrigerator 1 configured to be discussed above.

The rotary valve opens the exhaust valve 7 of the gas supply system 5 just before the first-stage and second-stage displacers 11, 21 reach the bottom dead center. More specifically, in the present embodiment, when the first-stage and second-stage displacers 11, 21 reach a 30 degree point before the bottom dead center (BDC) by the drive unit 3, the inlet valve 7 is configured to be opened. At this time, the exhaust valve 8 maintains a closed state.

This allows a high-pressure refrigerant gas generated in the gas compressor 6 to flow into the regenerator 12 formed in the first-stage displacer 11 through the gas passage 9 and the gas passage L1. The refrigerant gas flowed into the regenerator 12 proceeds, being cooled by a regenerator material 13 in the regenerator 12, and subsequently flows into the second-stage expansion chamber 25 through the gas passage L4.

After the inlet valve 7 is opened, the first-stage and second-stage displacers 11, 21 reach the bottom dead center that minimizes the volume of the first-stage and second-stage expansion chambers 15, 25 by being driven by the drive unit 3, and the downward (i.e., the arrow Z2 direction in the drawing) motion is momentarily stopped (i.e., the moving speed becomes zero).

After that, the first-stage and second-stage displacers 11, 21 start to move upward (i.e., the arrow Z1 direction in the drawing). This causes the high-pressure refrigerant gas supplied from the gas compressor 6 is supplied into (suctioned into) the first-stage expansion chamber 15 and the second-stage expansion chamber 25 through the above-mentioned route. Then, the inlet valve 7 is closed when the first-stage and second-stage displacers 11, 21 reach a 121 degree point, and the supply of the refrigerant gas from the gas supply system 5 to the GM refrigerator 1 is stopped.

After the inlet 7 is closed, when the first-stage and the second-stage displacers 11, 21 further move upward and reach a 170 degree point, the rotary valve opens the exhaust valve 8. On this occasion, the inlet valve 7 maintains the closed state. This causes the refrigerant gases in the first-stage and second-stage expansion chambers 15, 25 to expand, which generates cooling in respective expansion chambers 15, 25.

After the exhaust valve 8 is opened, the first-stage and second-stage displacers 11, 21 reach the top dead center by being driven by the drive unit 3, and stop moving upward (i.e., the arrow Z1 direction in the drawing), which means the moving speed becomes zero. After that, the first-stage and second-stage displacers 11, 21 start to move downward (i.e., the arrow Z2 direction in the drawing). As a result, the refrigerant gas expanded in the second-stage expansion chamber 25 flows into the regenerator 22 through the gas passage L4; passes the regenerator 22, cooling the regenerator material 23 in the regenerator 22; and flows into the first-stage expansion chamber through the gas passage L3.

The refrigerant gas flowed into the first-stage expansion chamber 15 flows into the regenerator 12 through the gas passage L2. The refrigerant gas flowed into the regenerator 12 proceeds forward, cooling the regenerator material 13, and is recovered into the gas compressor 6 of the gas supply system 5 through the gas passage L1, the gas passage 9 and the exhaust valve 8. Then, the exhaust valve 8 is closed when the first-stage and second-stage displacers 11, 21 reach a 340 degree point, and the recovery (suction) treatment of the refrigerant gas from the GM refrigerator 1 to the gas supply system 5 is stopped.

By repeating the above cycle, a cryogenic temperature of about 20 to 50 K or less can be generated in the first-stage expansion chamber 15, and a very low temperature of about 4 to 10 K or less can be generated in the second-stage expansion chamber 25.

Figure 3:
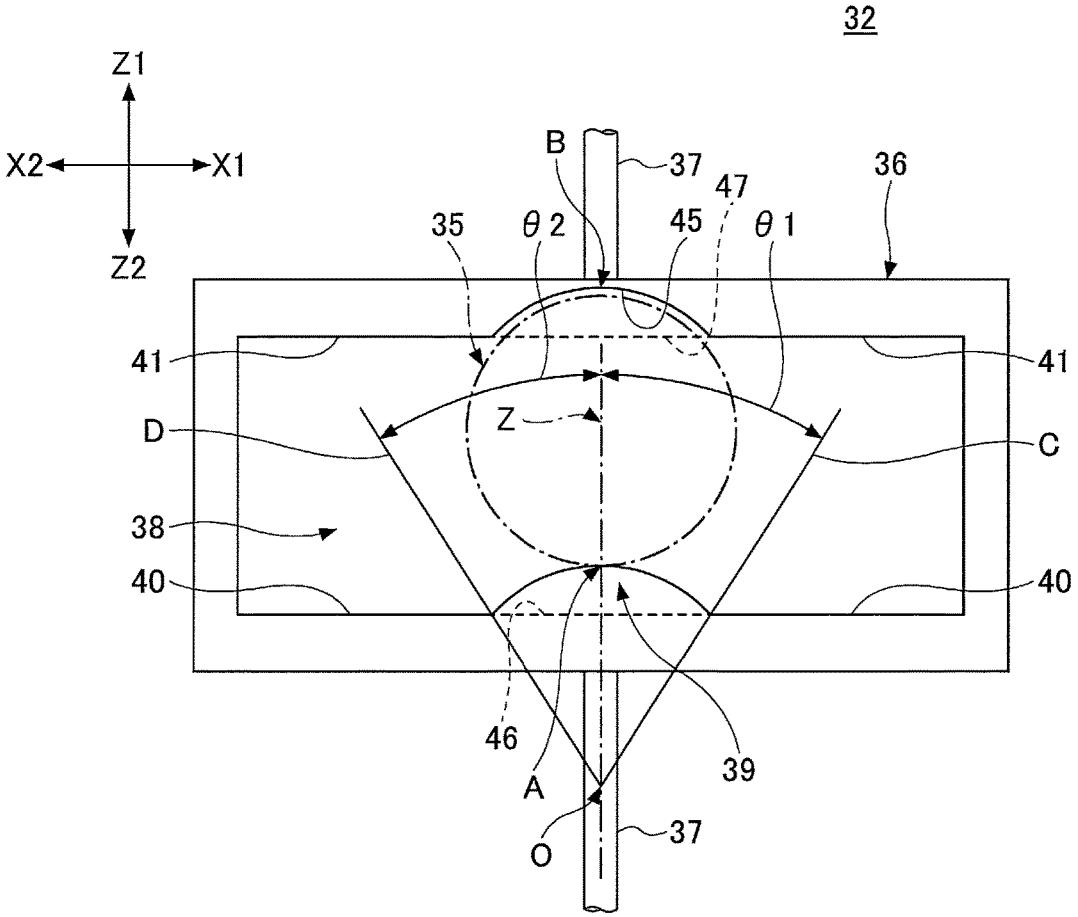
FIG. 3 is an enlarged diagram showing a slider frame of the Scotch-yoke mechanism.

Here, focusing on the Scotch-yoke 36 constituting the drive unit 3, a description is given about a structure and a function thereof, mainly referring to FIGS. 2 and 3.

FIG. 3 is a diagram of the Scotch yoke 36 as seen from the front. As mentioned above, the slide groove 38 that extends in the X1, X2 directions is formed in the Scotch-yoke 36. A conventional slide groove in the Scotch-yoke is formed into a horizontally long rectangular shape in general.

In contrast, the present embodiment is configured to include a convex part 39 provided at a position corresponding to the bottom dead center (i.e., a position shown by an arrow A in FIG. 3, which is hereinafter called the "bottom dead center corresponding position A") of the displacers 11, 21 in the slide groove 38 so as to protrude upward (i.e., in the Z1 direction). Moreover, a concave part 45 is formed about at a position corresponding to the top dead center of the displacers 11, 21 (i.e., a position shown by an arrow B, which is called hereinafter the "top dead center corresponding position B") in the slide groove 38 so as to hollow upward (i.e., in the Z1 direction).

Here, a line segment that extends in the vertical direction (i.e., the Z1, Z2 directions) and passes through the bottom dead center corresponding position A is assumed. This line segment is shown by an alternate long and short dashed line in FIG. 3, and is hereinafter called a center line Z. The above discussed drive arm 37 is configured to form a straight line with the center line Z.

The convex part 39 is made of an arc shape centering a position shown by an arrow O in the drawing (which is hereinafter called a center point O), and is configured to form a circular shape part.

In the present embodiment, the convex part 39 has a symmetric shape in an arrow X1 direction side and an arrow X2 direction side with the center line Z at its center.

Accordingly, if a straight line connecting the center point O to the end on the X1 direction side of the convex part 39 is made of a line segment C, and a straight line connecting the center point O to the end on the X2 direction side of the convex part 39 is made of a line segment D, an angle θ1 between the line segment C and the center line Z is the same as an angle θ2 between the line segment D and the center line Z (θ1=θ2).

A measure of these angles is not specified, but is set at θ1=θ2=30 degrees in the present embodiment. However, these angles are not limited to this, for example, may be set in a range of 20 degrees≤(θ1=θ2)≤40 degrees.

Here, the angles θ1, θ2 that define a formation range of the convex part 39 are not necessarily set at the same angle to each other as mentioned above, but may be configured to have different angles (θ1≠θ2).

Next, a description is given about operation of the respective displacers 11, 21 using the Scotch-yoke mechanism 32 including the Scotch-yoke 36 configured as discussed above, with reference to FIGS. 4 and 5.

Figure 4:
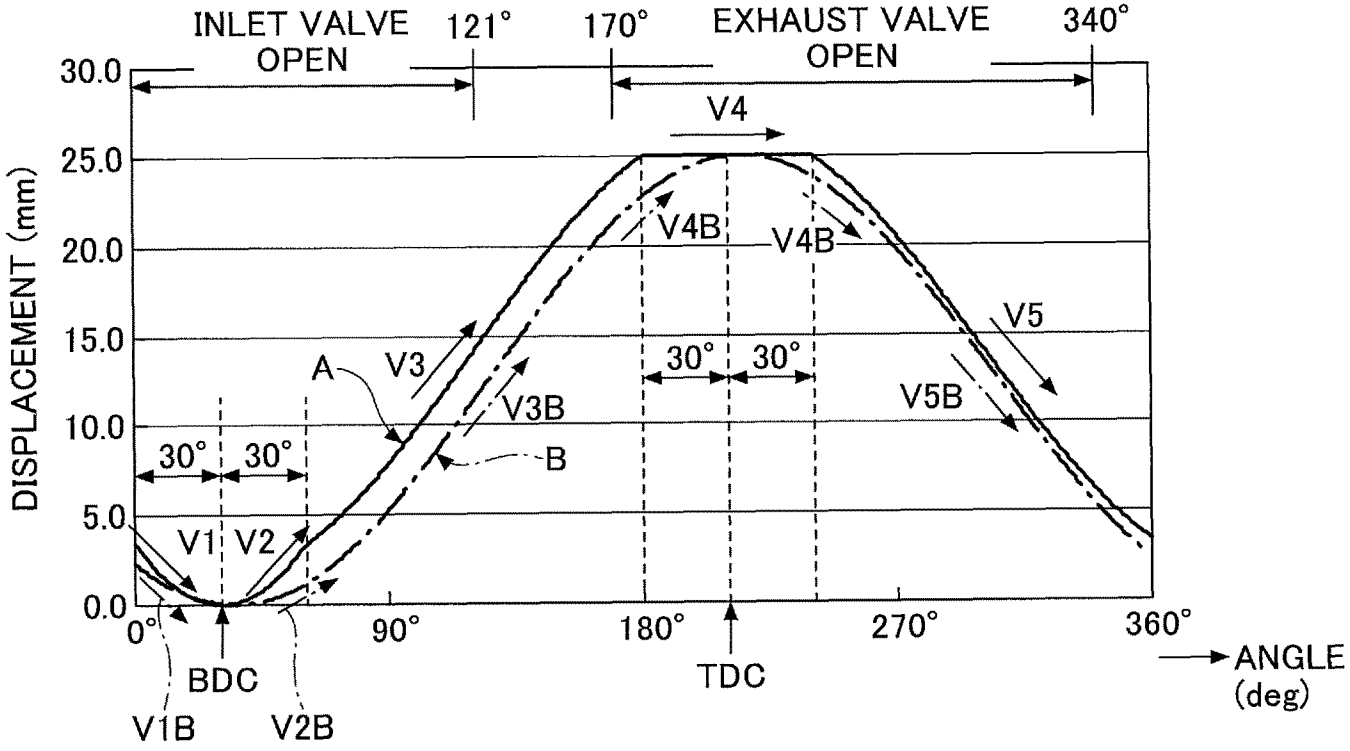
FIG. 4 is a motion curve diagram of the displacer in the GM refrigerator of the first embodiment of the present invention.

FIG. 4 is a motion curve diagram of the displacers 11, 21. Furthermore, FIGS. 5A through 5H show operations of the roller bearing in the slide groove 38.

Here in FIG. 4, the transverse axis shows a rotation angle (i.e., crank angle) of the crank member 34, and the longitudinal axis shows a displacement (travel distance) of the second-stage displacer 21. In addition, a characteristic of the GM refrigerator 1 of the present embodiment is shown by a solid line (which is shown by an arrow A in the drawing), a characteristic of a conventional GM refrigerator without the convex part 39 and the concave part 45 is shown by an alternate long and short dashed line (which is shown by an arrow B).

Figure 5A:
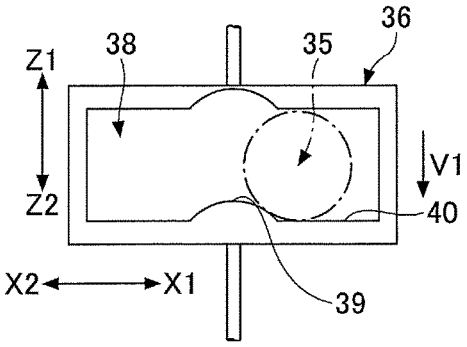
FIGS. 5A through 5H are diagrams for illustrating operation of the Scotch-yoke mechanism provided in the GM refrigerator of the first embodiment of the present invention.
Figure 5E:
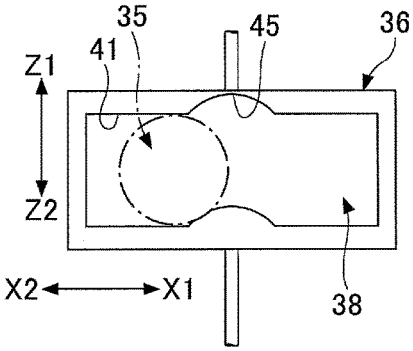

In the Scotch-yoke mechanism 32 of the present embodiment, the crank angle 0 degree is set at a 30 degree point before the bottom dead center (BDC). Hence, as shown in FIG. 5A, a position of the roller bearing 35 in the slide groove 38 when the crank angle is 0 degree is located at a border between a lower horizontal part 40 and the convex part 39.

When the crank member 34 rotates 30 degrees from this state, following this, the roller bearing 35 biases the Scotch-yoke 36 downward (i.e., in a Z2 direction). This operation causes the roller bearing 35 to be moved in an X2 direction in a slide groove 38. More specifically, the roller bearing 35 engages with the convex part 39 caused by the movement, and enters a state of the roller bearing 35 running on the convex part 39.

As stated above, because the crank pin 34*a* to which the roller bearing 35 is attached is provided at a position eccentric to the center of the crank member 34, following the movement of the roller bearing 35, the Scotch-yoke 36 moves toward the Z2 direction. In addition, the displacers 11, 21 are connected to the Scotch-yoke 36 via the drive arm 37. Because of this, as the Scotch-yoke 36 moves, the displacer 11, 21 move toward the Z2 direction.

Here, the moving speed of the Scotch-yoke 36 (which is equal to the moving speed of the displacers 11, 21) is noted.

The convex part 39 protrudes compared to the lower horizontal part 40. Hence, a travel distance of the Scotch-yoke 36 per unit time when the roller bearing 35 is engaged with the convex part 39 is longer than when the roller bearing 35 is engaged with the conventional horizontal part 46 (see FIG. 3).

In other words, the moving speed V1 of the Scotch-yoke 36 moving downward (in the Z2 direction) following the movement of the roller bearing 35 (see FIG. 4) becomes faster than the moving speed V1B of the Scotch-yoke 36 when the roller bearing 35 is engaged with the conventional lower horizontal part 46 (V1B<V1).

Figure 5B:
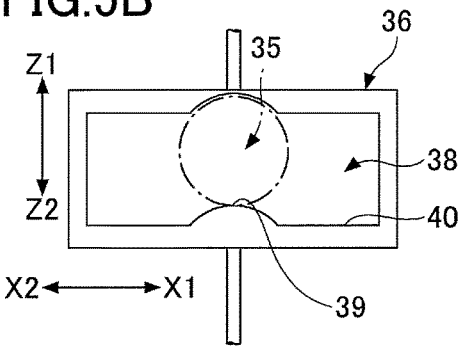
Figure 5F:
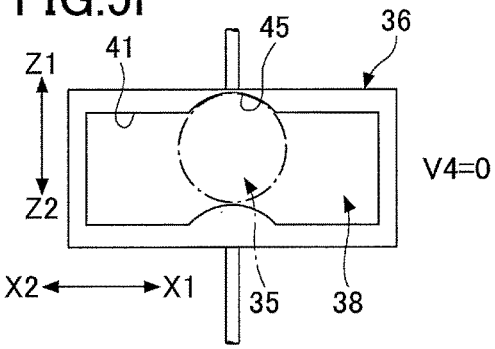

FIG. 5B shows a state of the crank angle being 30 degrees. In the present embodiment, the displacers 11, 21 are set to be the bottom dead center (BDC) when the crank angle is 30 degrees. Due to this, in the bottom dead center, the roller bearing 35 is located at the top (the center position) of the convex part 39.

Following the crank member 34, when the roller bearing 35 passes the position corresponding to the bottom dead center (BDC) of the displacers 11, 21, the moving direction of the Scotch-yoke 36 is reversed. In other words, after passing the bottom dead center (BDC), the Scotch-yoke 36 starts to move upward (in the Z1 direction).

Figure 5C:
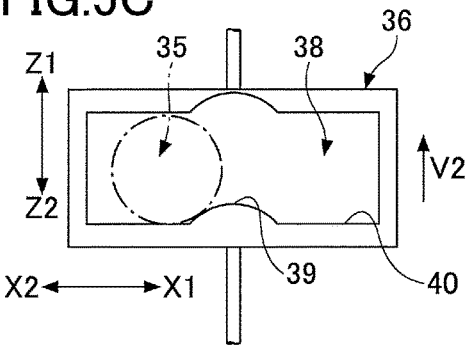

At this time, the crank angle maintains a state of the roller bearing 35 being engaged with the convex part 39 while the crank angle is from the bottom dead center (BDC) to 30 degrees. More specifically, the roller bearing 35 keeps the state of the roller bearing 35 being engaged with the convex part 39 (concretely, a part on the X2 direction side relative to the center axis Z), and moves to a position facing the horizontal parts 40, 41 (the state of which is shown in FIG. 5C).

Accordingly, the moving speed V2 (see FIG. 4) of the Scotch-yoke 36 moving upward (in the Z1 direction) caused by the movement of the roller bearing 35 becomes faster than the moving speed V2B of the Scotch-yoke 36 when the roller bearing 35 is engaged with the conventional horizontal part 46 (V2B<V2). This is similar to a case where the roller bearing 35 moves from the state shown by FIG. 5A to the state shown by FIG. 5B.

Figure 5G:
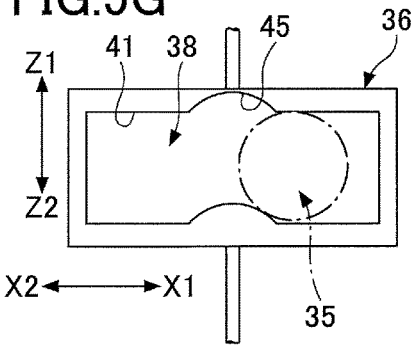
Figure 5D:
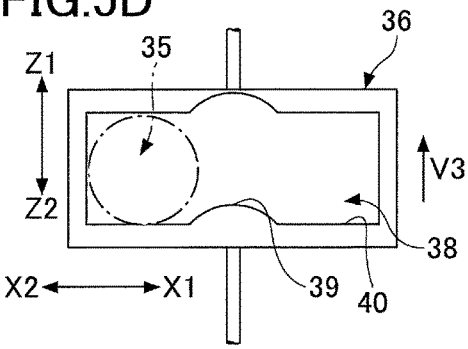

Moreover, as shown in FIG. 5D, when the crank member 34 further rotates, the roller bearing 35 moves and reaches a position facing the horizontal parts 40, 41 in the slide groove 38. A moving speed V3 of the Scotch-yoke 36 in the Z1 direction is made V3 at this time. The moving speed V3 of the Scotch-yoke 36 is approximately the same as the conventional moving speed V3B because the roller bearing 35 is engaged with the horizontal part 40.

Furthermore, as stated above, a shape of the convex part 39 is symmetrical about the center line Z in the present embodiment. Accordingly, the moving speeds V1, V2 of the Scotch-yoke 36 in a range of back and forth 30 degrees of the bottom dead center corresponding position A is different in direction but the same in absolute value. Here, when the shape of the convex part 39 is made symmetric about the center line Z, production of the Scotch-yoke 36 is made simple.

In addition, as stated above, in the present embodiment, the arc-shaped convex part 39 is structured to directly engage with the horizontal part 40. However, in order to make the roller bearing 35 move smoothly, a smooth connection part (e.g., a straight line) may be provided between the arc-shaped convex part 39 and the horizontal part 40.

FIGS. 5E through 5H show operation of the roller bearing 35 when engaged with the concave part 45. The concave part 45 is made of a hollow shape relative to the upper horizontal part 41. With respect to this concave part 45, while the roller bearing 35 is engaged with the concave part 45, a moving speed V4 of the Scotch-yoke 36 (i.e., displacers 11, 21) is slower than a moving speed V4B of the Scotch-yoke 36 when the roller bearing 35 is engaged with the conventional horizontal part 47 (V4<V4B).

Moreover, the concave part 45 is formed across a range of ±30 degrees when expressed in a crank angle of the crank member 34, centering a position to be the top dead center corresponding position B. Accordingly, as shown in FIG. 4, the moving speed V4 of the displacers 11, 21 in the range of ±30 degrees with the top dead center (TDC) at the center is slower than the moving speed V4B of the Scotch-yoke 36 when the roller bearing 35 is engaged with the conventional horizontal part 47 (V4<V4B).

Figure 5H:
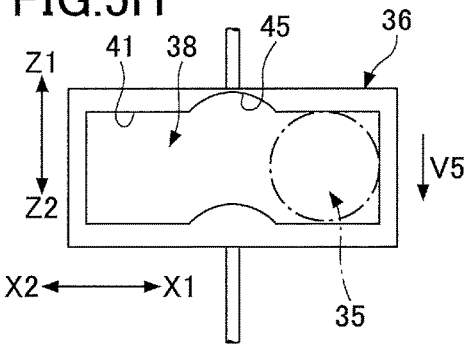

Then, the crank member 34 further rotates from the state shown in FIG. 5G, as shown in FIG. 5H, the roller bearing 35 moves to a position facing the horizontal parts 40, 41 in the slide groove 38. This causes the Scotch-yoke 36 to start moving, which further causes the displacers 11, 21 to start moving.

If a moving speed of the Scotch-yoke 36 in the Z1 direction at this time is made V5, because the roller bearing 35 is engaged with the horizontal part 41, the moving speed V5 is approximately the same as the conventional moving speed V5B.

As is clear from the above description, the GM refrigerator 1 of the present embodiment is set so that the moving speeds V1, V2 at the bottom dead center of the displacers 11, 21 are faster than the moving speed V4 at the top dead center (V4<V1, V4<V2). Therefore, as shown in FIG. 4, the motion curve of the displacers of the present embodiment (a solid line shown by an arrow A in the drawing) has a steeper characteristic curve than the motion curve of the displacers of the conventional GM refrigerator (an alternate long and short dashed line shown by an arrow B) in the vicinity of the bottom dead center.

Here, "the moving speeds of the displacers 11, 21 at the bottom dead center" mean moving speeds of the displacers 11, 21 in a range of the convex part 39 formed in the slide groove 38. Moreover, "the moving speeds at the top dead center" means moving speeds of the displacers 11, 21 in a range of the concave part 45 formed in the slide groove 38.

Furthermore, the GM refrigerator 1 in the present embodiment is configured to allow the inlet valve 7 to be opened when the displacers 11, 21 reach the point of 30 degrees before the bottom dead center (BDC). Hence, in the present embodiment, when the inlet valve 7 is opened, the moving speed of the displacers 11, 21 changes from V5 to V1 (which is faster than the conventional V1B) at the same time.

Here in the present embodiment, a timing when the moving speeds of the displacers 11, 21 (Scotch-yoke 36) change in the vicinity of the top dead center is set to be the same as a timing when the inlet valve 7 is opened, but the timing of the inlet valve 7 being opened can be set earlier than the timing when the moving speeds of the displacers 11, 21 (Scotch-yoke 36) change.

In a case of the above-mentioned configuration, since the inlet valve 7 is opened until the displacers 11, 21 reach the bottom dead center (Scotch-yoke 36), the moving speeds of the displacers 11, 21 (Scotch-yoke 36) become fast.

In addition, in the present embodiment, since the displacers 11, 21 (Scotch-yoke 36) reach the bottom dead center until the exhaust valve 8 is opened, the moving speeds of the displacers 11, 21 (Scotch-yoke 36) become approximate the same as the moving speeds of the conventional displacers. More specifically, the moving speeds of the displacers 11, 21 (Scotch-yoke 36) are changed from the moving speed V2 to the moving speed V3 at 30 degrees of the crank angle, and become approximately the same as the conventional moving speed V3B. Here, the inlet valve 7 in the present embodiment is closed at 121 degrees of the clank angle.

Next, a description is given about a functional effect of setting the moving speeds V1, V2 at the bottom dead center of the displacers 11, 21 faster than the moving speed V4 at the top dead center.

As discussed above, by allowing the inlet valve 7 to be opened, the high-pressure refrigerant gas is supplied from the gas supply system to the GM refrigerator 1. The refrigerant gas has a characteristic whose density increases as pressure increases. Hence, pressure loss becomes small as pressure increases.

In addition, in the present embodiment, by increasing the moving speeds V1, V2 of the displacers 11, 21 at the bottom dead center, a gas flow rate from the gas supply system 5 into the GM refrigerator 1 can be increased. In this manner, even if the gas flow rate into the GM refrigerator 1 is increased, the pressure loss is low because the refrigerant gas is at a high pressure. This enables a large amount of refrigerant gas to be supplied into the GM refrigerator 1 efficiently.

Therefore, after supplying the refrigerant gas to the GM refrigerator 1, and opening the exhaust valve 8 after closing the inlet valve 7, it is possible that a large amount of the refrigerant gas can be expanded. Therefore, cooling efficiency of the GM refrigerator 1 can be improved.

In this way, in order to supply the high-pressure refrigerant gas to the GM refrigerator 1, it is favorable to configure the GM refrigerator 1 so as to increase the moving speeds of the displacers 11, 21 since the inlet valve 7 is opened until the displacers 11, 21 reach the bottom dead center.

Figures 6, 7:
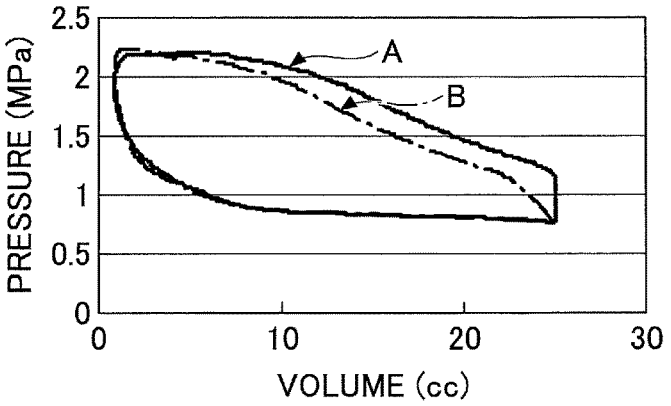
FIG. 6 is a P-V diagram of the GM refrigerator of the first embodiment of the present invention.
FIG. 7 is a diagram showing an effect of the first embodiment of the present invention.

FIG. 6 shows a P-V line diagram of the GM refrigerator 1 in the present embodiment (a characteristic shown by an arrow A), and a P-V line diagram of a GM refrigerator without the convex part 39 in the slide groove 38 (a characteristic shown by an arrow B) as a comparative example together.

In the P-V line diagram, a cooling capacity generated in one cycle of the GM refrigerator corresponds to an area surrounded by the P-V diagram. Referring to FIG. 6, it is noted that the area of the P-V diagram of the present embodiment is larger than that of the P-V diagram of the conventional GM refrigerator. Accordingly, FIG. 6 demonstrates that the GM refrigerator 1 of the present embodiment has a higher cooling efficiency than that of the conventional GM refrigerator.

FIG. 7 is a table showing a cooling temperature of the GM refrigerator 1 of the present embodiment, compared with a cooling temperature of the conventional GM refrigerator. In both GM refrigerators, a temperature near the first-stage expansion chamber and a temperature near the second-stage expansion chamber are measured.

As shown in FIG. 7, a first-stage temperature of the GM refrigerator of the present embodiment was 45.1 K in comparison with that of the conventional GM refrigerator being 46.2 K. Moreover, a second-stage temperature was 4.19 K compared to that of the conventional GM refrigerator being 4.26 K. Therefore, FIG. 7 also demonstrates that the GM refrigerator 1 of the present embodiment has a higher cooling efficiency than that of the conventional GM refrigerator.

Figure 8:
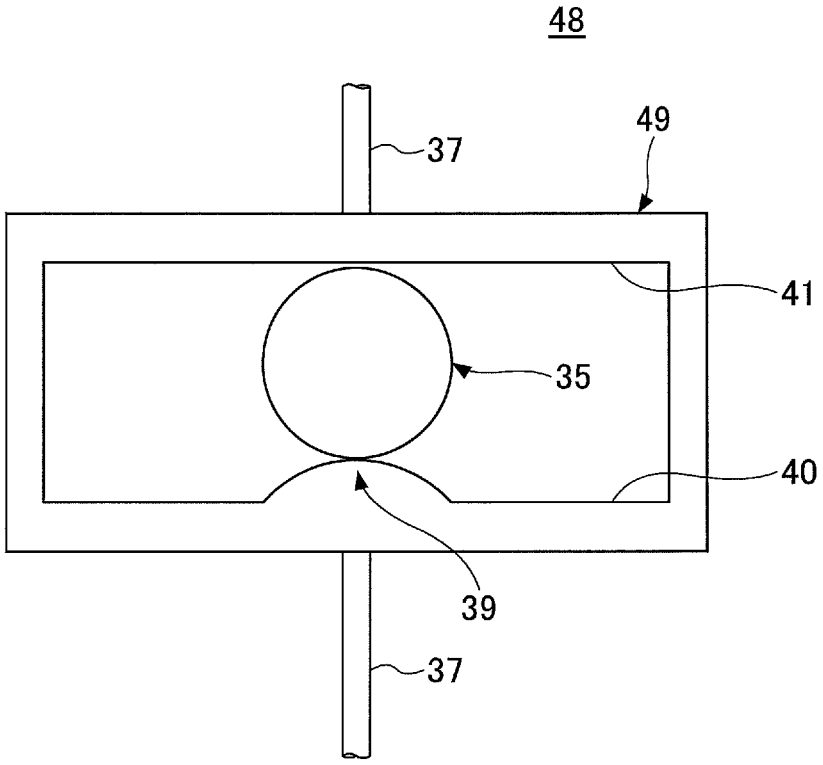
FIG. 8 is an enlarged diagram showing a Scotch-yoke mechanism of a modification of the first embodiment.

FIG. 8 shows a Scotch-yoke mechanism 48 of a GM refrigerator that is a modification of the present embodiment. More specifically, FIG. 8 shows an enlarged Scotch-yoke 49 of the Scotch-yoke mechanism 48. In FIG. 8, the same numerals are put to components corresponding to those shown in FIG. 1 through FIG. 5, and the description is omitted.

The Scotch-yoke mechanism 32 provided in the GM refrigerator 1 shown in FIG. 1 through FIG. 5 is configured to provide the concave part 45 in the upper horizontal part 41 of the Scotch-yoke 36. In contrast, the present modification features not to provide the concave part 45 in the upper horizontal part 41 but to be configured to be flat.

Figure 9:
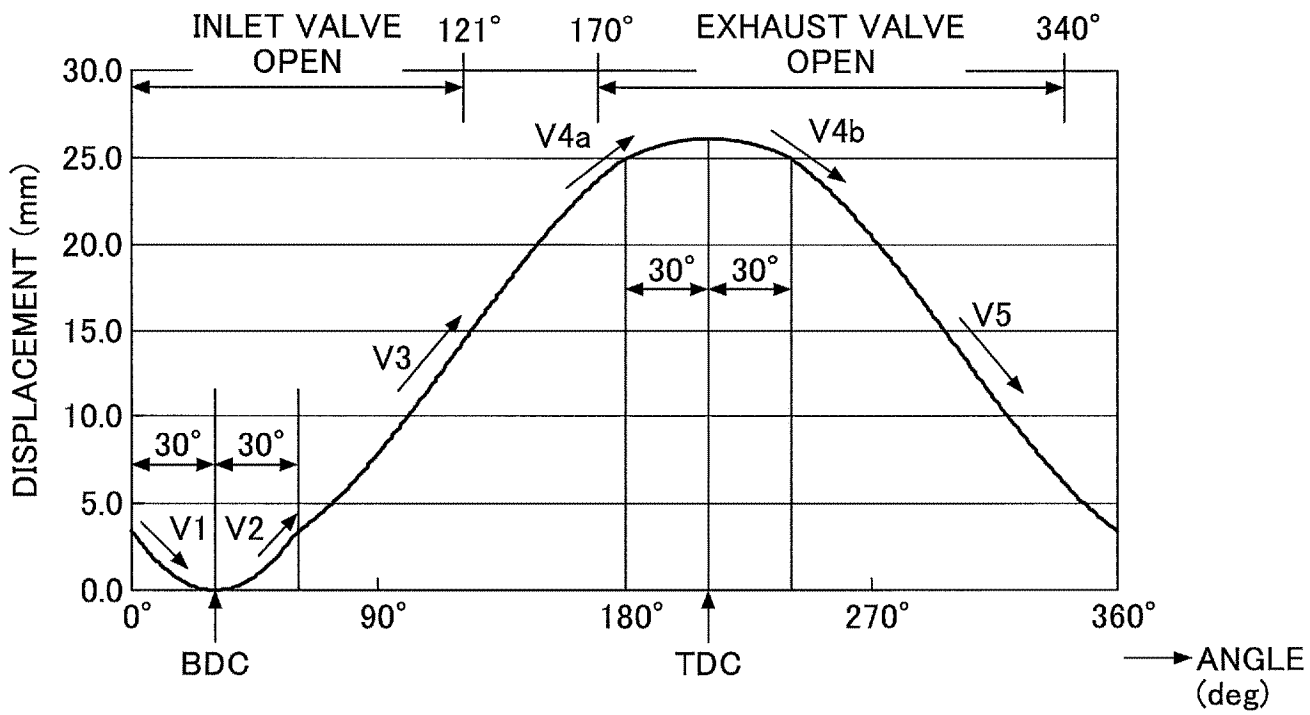
FIG. 9 is a motion curve diagram of a displacer in a GM refrigerator of a modification of the first embodiment.

FIG. 9 is a motion curve diagram of displacers 11, 21 of the GM refrigerator using the Scotch-yoke 49 shown in FIG. 8. In the GM refrigerator of the present modification, because the concave part 45 is not provided in the upper horizontal part 41, the displacers 11, 21 are not stopped in the vicinity of the top dead center, and the movement becomes like a simple harmonic motion.

Here, moving speed of the displacers 11, 21 from a point of 30 degrees before the bottom dead center (TDC) to the bottom dead center is V4*a*, and moving speeds of the displacers 11, 21 from the top dead center to a point of 30 degrees after the top dead center (TDC) is V4*b*.

As discussed above, because the roller bearing 35 is engaged with the convex part 39 formed in the lower horizontal part 40, the moving speeds V1, V2 of the displacers 11, 21 in the vicinity of the bottom dead center (BDC) are faster than those when the roller bearing 35 is engaged with the horizontal parts 40, 41. Accordingly, the configuration of the modification also allows the moving speeds V1, V2 of the displacers 11, 21 in the vicinity of the bottom dead center to be faster than the moving speeds V4*a*, V4*b* of the displacers 11, 21 in the vicinity of the top dead center.

Therefore, with the modified GM refrigerator, the cooling efficiency can also be improved like the above-mentioned GM refrigerator 1 of the embodiment.

Here in the present embodiment, a description is given about an example of the convex part 39 being an arc shape, but a shape of the convex part 39 is not limited to the arc shape. As long as the convex part 39 has a shape protruding above the lower horizontal part 40, for example, configuring the convex part 39 by combining plural straight lines and curves is possible.

Next, a description is given about a second embodiment of the present invention.

Figure 10:
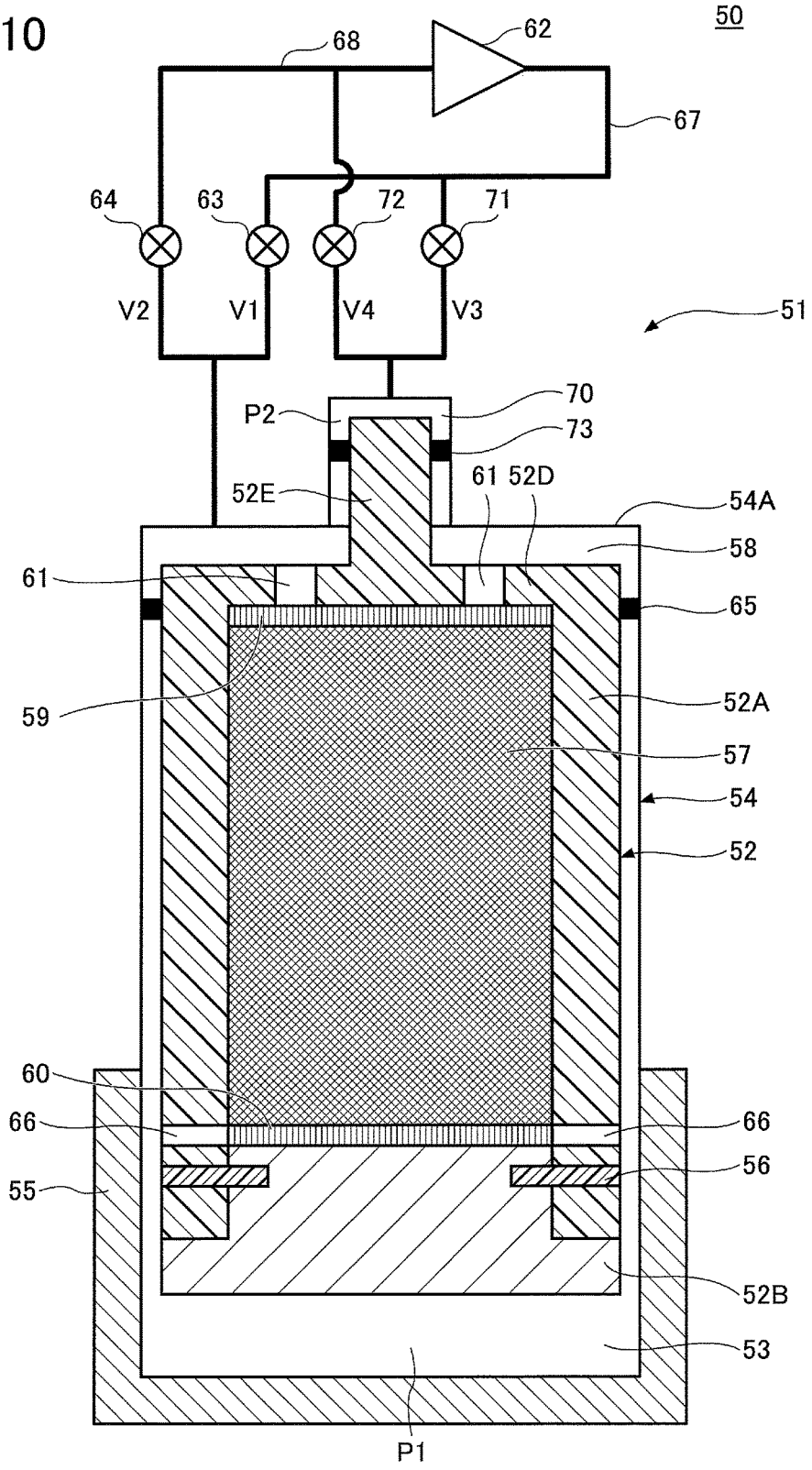
FIG. 10 is an outline configuration diagram of a GM refrigerator of a second embodiment of the present invention.

FIG. 10 shows a GM refrigerator 50 of the second embodiment. In the present embodiment, a description is given about a one-stage GM refrigerator as an example.

The GM refrigerator 50 includes a drive unit 51, a displacer 52, a cylinder 54, a cooling stage 55, a regenerator 57, compressor 62 and the like. The GM refrigerator of the present embodiment features to adopt a pneumatic mechanism as the drive unit 51 to drive the displacer 52.

The displacer 52 is configured to include a displacer body 52A, a lower temperature side thermal conduction part 52B, regenerator 57 and the like. The displacer body 52A is formed into a cylindrical shape with caps on the end, and the regenerator 57 housing a regenerator material is provided therein.

A rectifier 59 that rectifies a flow of a refrigerant gas is provided on the high-temperature side (the upper side is the high-temperature side in the drawing). Furthermore, a rectifier 60 that rectifies a flow of a refrigerant gas is also provided on the low-temperature side (the lower side is the low temperature side in the drawing).

In a top plate part 52D that is located at the high-temperature end of the displacer 52, plural flow passages 61 are provided to flow the refrigerant gas from a room temperature chamber 58 to the regenerator 57. The room temperature chamber 58 is formed between the top plate part 52D of the displacer 52 and a top plate part 54A of the cylinder 54.

This room temperature chamber 58 is connected to the compressor 62. More specifically, the room temperature chamber 58 is connected to a supply pipe 67 that is connected to a supply side of the compressor 62, and is connected to a return pipe 68 that is connected to a return side of the compressor 62. The supply pipe 67 is connected to the room temperature chamber 58 through an inlet valve 63 (which may be called V1). Moreover, the return pipe 68 is connected to an exhaust valve 64 (which may be called V2) through the room temperature chamber 58. Here, the respective pipes 67, 68 join together and become one on the downstream side of the respective valves 63, 64 and are connected to the room temperature chamber 58.

Therefore, when the inlet valve 63 is opened and the exhaust valve 64 is closed, the high-pressure refrigerant gas generated by the compressor 62 is supplied to the room temperature chamber 58. In contrast, when the inlet valve 63 is closed and the exhaust valve 64 is opened, the refrigerant gas is flowed back from the room temperature chamber 58 to the compressor 62.

On the low-temperature end of the displacer 52, a low-temperature side thermal conduction part 52B is provided. Furthermore, a second passage 66 in communication with the regenerator 57 and an expansion space 53 is formed between the displacer 52A and the low-temperature side thermal conduction part 52B. The low-temperature side thermal conduction part 52B is joined to the displacer body 52A by using a pin 56.

The expansion space 53 is formed between the cylinder 54 and the displacer 52 (the low-temperature side thermal conduction part 52B). The high-pressure refrigerant gas from the compressor 62 is introduced into the expansion space 53. In addition, the expansion space 53 is configured to generate a cooling therein by allowing the introduced refrigerant gas to be adiabatically expanded.

The cylinder 54 houses the displacer 52 in a movable state therein. The cylinder 54 has a cylindrical shape with caps on the ends, and a cooling stage 55 is provided on the low-temperature end to be an opening side. This cooling stage 55 is thermally connected to an object to be cooled, and the object to be cooled is cooled by a cooling generated in the expansion space 53.

Moreover, a seal 65 is installed between the cylinder 54 and the displacer 52. This seal 65 prevents the refrigerant gas supplied from the compressor 62 from passing a gap between the displacer 52 and the cylinder 54 and from flowing into the expansion space 53.

On the high-temperature side of the cylinder 54, a drive unit 51 that drives the displacer 52 is provided. The drive unit 51 is configured to include a drive piston 52E, a drive chamber 70, a high-pressure driving valve 71, a low-pressure driving valve 72, and the like. Furthermore, in the present embodiment, a high-pressure refrigerant gas generated in the compressor 62 is used as a driving gas.

The drive piston 52E constitutes a wall on the displacer side of the drive chamber 70, and is configured to be integrated with the displacer 52. The drive piston 52E can be provided, for example, so as to protrude upward from the center position of the top plate 52D of the displacer 52. Accordingly, when the drive piston 52E moves up and down, following this, the displacer 52 moves up and down in the cylinder 54.

The drive chamber 70 is formed at the center position of the top place part 54A of the cylinder 54. This drive chamber 70 is configured to protrude upward from the top plate 54A, and the above drive piston 52E is configured to be movable in a vertical direction (in an axial direction of the cylinder 54) in the drive chamber 70.

In addition, a seal 73 is installed at a predetermined position of the drive chamber 70. The seal 73 is installed between an inner wall of the drive chamber 70 and the displacer 52E. This allows the drive chamber 70 to be configured to be hermetically separated from the room temperature chamber 58. Moreover, by providing the seal 73, the drive piston 52E can move up and down, maintaining a hermetical state of the drive chamber 70.

Furthermore, the drive chamber 70 is connected to the compressor 62. More specifically, the supply pipe 67 and the return pipe 68 are connected to the drive chamber 70. The supply pipe 67 is connected to the drive chamber 70 through the high-pressure driving valve 71 (which may be called the valve V3). Also, the return pipe 68 is connected to the drive chamber 70 through the low-pressure driving valve (which may be called the valve V4). Here, the respective pipes 67, 68 join together and become one on the downstream side of the drive chamber 70, and are connected to the drive chamber 70.

Therefore, when the high-pressure driving valve 71 is opened and the low-pressure driving valve 72 is closed, the high-pressure refrigerant gas generated in the compressor 62 is supplied to the drive chamber 70, and a pressure (which is hereinafter called a "P2") in the drive chamber 70 becomes high. In contrast, when the high-pressure driving valve 71 is closed and the low-pressure driving valve 72 is opened, the refrigerant gas in the drive chamber 70 flows back to the compressor 62 and the pressure P2 in the drive chamber 70 becomes low.

In this manner, the pressure P2 in the drive chamber 70 can be controlled by opening and closing the high-pressure driving valve 71 and the low-pressure driving valve 72. On the other hand, a pressure (which is hereinafter called a "P1") in the cylinder 54 can be controlled by open and close of the inlet valve 63 and the exhaust valve 64.

Accordingly, when the pressure P1 in the cylinder 54 becomes higher than the pressure P2 in the drive chamber 70 (P2<P1) by the open and close control of the respective valves 63, 64, 71 and 72, the displacer 52 moves upward (the movement toward the top dead center direction). On the contrary, when the pressure P1 in the cylinder 54 is lower than the pressure P2 in the drive chamber 70 (P1<P2), the displacer 52 moves downward (the movement toward the bottom dead center direction). In this way, the GM refrigerator 50 of the present embodiment is configured to cause the drive unit 51 to drive the displacer 52.

Here, the respective valves 63, 64, 71 and 72 (valves V1, V2, V3, and V4) are configured to be integrated as a rotary valve, and the GM refrigerator 50 is configured to cause the displacer 52 to move back and forth once (i.e., to perform one cycle movement) by one revolution of the rotary valve (revolution of 360 degrees).

Next, referring to FIG. 11, a description is given about operation of the GM refrigerator 50 configured as the above.

Figure 11A:
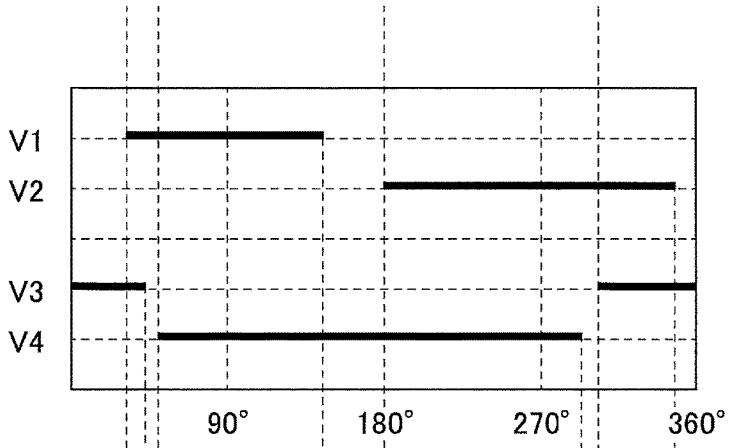
FIG. 11A is a diagram showing a valve timing of the GM refrigerator of the second embodiment of the present invention.
Figure 11B:
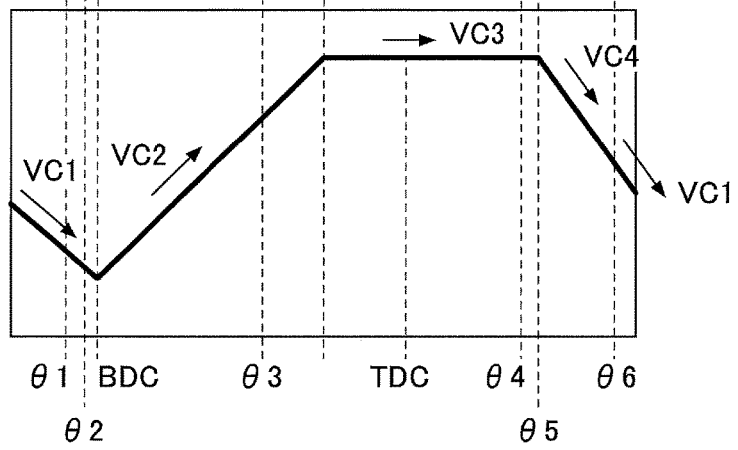
FIG. 11B is a motion curve diagram of a displacer in the GM refrigerator of the second embodiment of the present invention.

FIGS. 11A and 11B show operation of the GM refrigerator 50 of the present embodiment. FIG. 11A shows valve timing of the GM refrigerator 50 of the present embodiment, and FIG. 11B shows movement of the displacer 52 in the GM refrigerator 50.

Here in FIG. 11A, bold solid lines show periods that respective valves 63, 64, 71 and 72 (valves V1, V2, V3 and V4) are opened, and a transverse axis shows a rotation angle of the rotary valve (which is hereinafter just called "a valve rotation angle"). Moreover, in FIG. 11B, a transverse axis shows a rotation angle of the rotary valve, and a longitudinal shows an amount of displacement of the displacer 52.

Referring to FIG. 11A, when the valve rotation angle is 0 degree, only the high-pressure driving valve 71 (V3) constituting the drive unit 51 is opened, and the other valves 72, 63 and 64 (V1, V2 and V4) are kept closed. Hence, the refrigerant gas whose pressure is raised by the compressor 62 is supplied to the drive chamber 70 through the high-pressure driving valve 71 (V3).

Because of this, the pressure P2 in the drive chamber 70 becomes higher than the pressure P1 in the cylinder 54 (P1<P2). Accordingly, the displacer 52 moves downward toward the bottom dead center (BDC). Here, a moving speed of the displacer 52 in moving downward is made a VC1.

In the GM refrigerator 50 of the present embodiment, the bottom dead center (BDC) is set at an earlier angle (lower angle) than the valve rotation angle 90 degrees. In addition, the exhaust valve 63 (v1) is set to be opened at an earlier valve rotation angle θ1 than the bottom dead center (BDC). Moreover, the high-pressure driving valve 71 (V3) is set to be closed at a valve rotation angle θ2 between the valve rotation angle θ1 and the bottom dead center (BDC).

In this manner, when the high-pressure driving valve 71 (V3) is closed and the inlet valve 63 (V1) is opened, the high-pressure refrigerant gas is introduced from the compressor 62 into the cylinder 54 (the room temperature chamber 58 and the expansion space 53) though the inlet valve 63 (V1). This causes the pressure P1 in the cylinder 54 to be increased.

Furthermore, when the displacer 52 reaches the bottom dead center (BDC), the low-pressure driving valve 72 (V4) is opened. Due to this, since the drive chamber 70 is connected to the return pipe 68, the internal pressure P2 becomes low. Accordingly, the pressure P1 in the cylinder 54 becomes higher than the pressure P2 in the drive chamber 70, and the displacer 52 moves upward toward the top dead center (TDC). Here, a moving speed of the displacer 52 in moving upward is made a VC2.

Following this upward movement of the displacer 52, the high-pressure refrigerant gas generated by the compressor 62 is flowed into the expansion space 53 through the room temperature chamber 58, the flow passage 61, the regenerator 57, and the second flow passage 66. On this occasion, the refrigerant gas is cooled by the regenerator material in the regenerator 57.

The inlet valve 63 (V1) is closed at a valve rotation angle θ3. At the time of this valve rotation angle θ3, the cylinder 54 is filled up with the high-pressure refrigerant gas, and the internal pressure P1 is kept high. In addition, the low-pressure driving valve 72 (V4) is kept open at the valve rotation angle θ3, and the pressure P2 in the drive chamber 70 is kept low. Because of this, the displacer 52 continues to move upward even at the valve rotation angle θ3.

In the present embodiment, the GM refrigerator 50 is configured to open the exhaust valve 64 (V2) at the valve rotation angle 180 degrees. When the exhaust valve 64 (V2) is opened, the refrigerant gas in the expansion space 53 expands, and thereby a cooling occurs in the expansion space 53. The cooling generated in the expansion space 53 cools the object to be cooled connected to the cooling stage 55.

As stated above, after the exhaust valve 64 (V2) is opened, the low-pressure driving valve 72 (V4) is kept opened. By allowing the exhaust valve 64 (V2) to be opened, the pressure P2 in the cylinder 54 is low. Similarly, by allowing the low-pressure driving valve 72 (V4) to be opened, the pressure P2 in the drive chamber 70 is low. Moreover, in this state, space parts (the expansion space 53, the room temperature chamber 58 and the like) formed in the cylinder 54 and the drive chamber 70 are both connected to the return pipe 68.

Accordingly, in a state of the exhaust valve 64 (V2) and the low-pressure driving valve 72 (V4) being both opened, the pressure P1 in the cylinder 54 and the pressure P2 in the drive chamber 70 are approximately the same (P1≈P2). Thus, in a state of the pressure P1 in the cylinder 54 and the pressure P2 in the drive chamber 70 being approximately the same, the displacer 52 keeps being approximately stopped. Hence, a speed of the displacer 52 at this time is made a VC3, where VC3 equals approximately 0.

The low-pressure driving valve 72 (V4) is closed at a valve rotation angle θ4. Furthermore, when the low-pressure driving valve 72 (V4) is closed, the high-pressure driving valve 71 (V3) is opened at a valve rotation angle θ5 after that.

The low-pressure driving valve 72 (V4) is closed and the high-pressure driving valve 71 (V3) is opened, by which the high-pressure refrigerant gas is flowed into the drive chamber 70 from the compressor 62, and the pressure P2 in the drive chamber 70 is increased. On the other hand, the exhaust valve 64 (V2) is kept opened even at the valve rotation angle θ5, and the pressure P1 in the cylinder 4 is kept low. Accordingly, by allowing the high-pressure driving valve 71 (V3) to be opened, the drive piston 52E is biased downward, and the displacer 52 start to move downward toward the bottom dead center. A speed of the displacer 52 at this time is made a VC4.

When the displacer 52 moves downward in a state of the exhaust valve 64 (V2) being opened, the refrigerant gas in the cylinder 54 such as the expansion space 53, the room temperature chamber 58 and the like is flowed back to the compressor 62 through the return pipe 68.

After that, the exhaust valve 64 (V2) is closed at a valve rotation angle θ6. This causes the high-pressure refrigerant gas from the compressor 62 to be supplied only to the drive chamber 70 through the high-pressure driving valve 71 (V3), and therefore the downward moving speed of the displacer 52 becomes the above-mentioned VC1.

As is clear from the above description, in the GM refrigerator 50 of the present embodiment, the moving speeds VC1, VC2 of the displacer 52 in the vicinity of the bottom dead center (BDC) become faster than the moving speed VC3 in the vicinity of the bottom dead center (TDC) (VC3<VC1, VC3<VC2).

This depends on an open period of the low-pressure driving valve 72 (V4) being set to be longer than that of the high-pressure driving valve 71 (V3) in the present embodiment. More specifically, the low-pressure driving valve 72 (V4) is opened while the valve rotation angle is from the BDC to θ4 (about 245 degrees) the high-pressure driving valve 71 (V3), compared to the high-pressure driving valve 71 (V3) opened while the valve rotation angle is from θ5 to θ2 (about 120 degrees) in one cycle (360 degrees).

In this way, by extending the period when the low-pressure driving valve 72 (V4) is opened to be longer than the period when the high-pressure driving valve 71 (V3) is opened, the period when the low-pressure driving valve 72 (V4) and the inlet valve 63 (V1) are both opened (BDC to θ3), and the period when the low-pressure driving valve 72 (V4) and the exhaust valve 64 (V2) are both opened (180 degrees to θ4) can be increased.

In other words, by extending the period (BDC to θ3) when both low-pressure driving valve 72 (V4) and inlet valve 63 (V1) are opened, the speed VC2 of the displacer 52 moving upward can be increased. In addition, by extending the period (180 degrees to θ4) when both low-pressure driving valve 72 (V4) and exhaust valve 64 (V2) are opened, the speed of the displacer 52 becomes slow, and the speed in the vicinity of the bottom dead center (BDC) becomes relatively fast.

Thus, in the present embodiment, since the moving speeds V1, V2 at the bottom dead center (BDC) of the displacer 52 can be increased as well as the first embodiment, a large amount of refrigerant gas can be supplied into the GM refrigerator 50 (expansion space 53) efficiently. Hence, the large amount of refrigerant gas can be expanded in the expansion space 53 when a cooling is generated, and the cooling efficiency of the GM refrigerator 50 can be improved.

Figure 12:
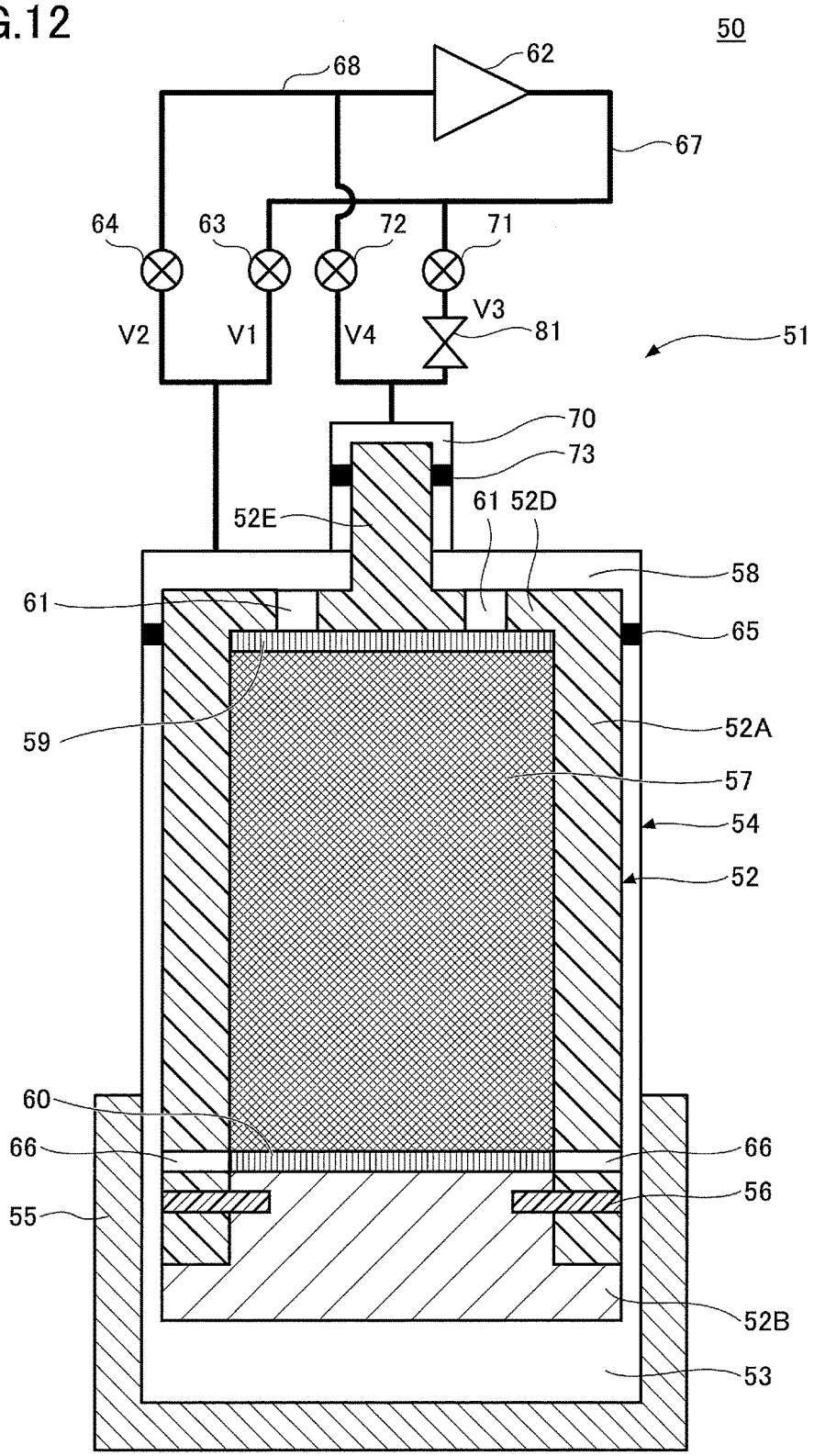
FIG. 12 is an outline configuration diagram of a GM refrigerator of a modification of the second embodiment.

FIG. 12 shows a GM refrigerator 80 of a modification of the GM refrigerator 50 of the second embodiment.

Here, in FIG. 12, the same numerals are put to components corresponding to those of the GM refrigerator of the second embodiment, and the description is omitted.

The GM refrigerator 80 of the present modification features to include a flow passage resistance valve 81 to be a flow resistance provided between the high-pressure driving valve 71 of the supply pipe 67 and the drive chamber 70. A needle valve that can adjust a valve opening position can be used for this flow passage resistance valve 81. By providing the flow passage resistance valve 81, a flow passage resistance between the high-pressure driving valve 71 of the supply pipe 67 and the drive chamber 70 becomes higher.

By doing this, at the time of intake that returns the refrigerant gas from the cylinder 54 to the compressor 62, a differential pressure between the pressure P1 in the cylinder 54 and the pressure P2 in the drive chamber 70 can be reduced, and a moving speed of the displacer 52 in the vicinity of the top dead center (TDC) can made be further slower. Moreover, by providing the flow passage resistance 81, since a speed of introducing a gas into the drive chamber 70 becomes slower, a period when the pressure in the drive chamber 70 is raised up to a high pressure becomes longer. This enables the pressure P1 in the cylinder 54 to be higher than the pressure P2 in the drive chamber 70 when the valve V1 is opened, and the moving speed of the displacer 52 in the vicinity of the bottom dead center (BDC) can be further faster. Therefore, the cooling efficiency can be enhanced further.

Here, a component used for the flow resistance is not limited to the needle valve, but using another component such as an orifice and the like is possible.

Figure 13:
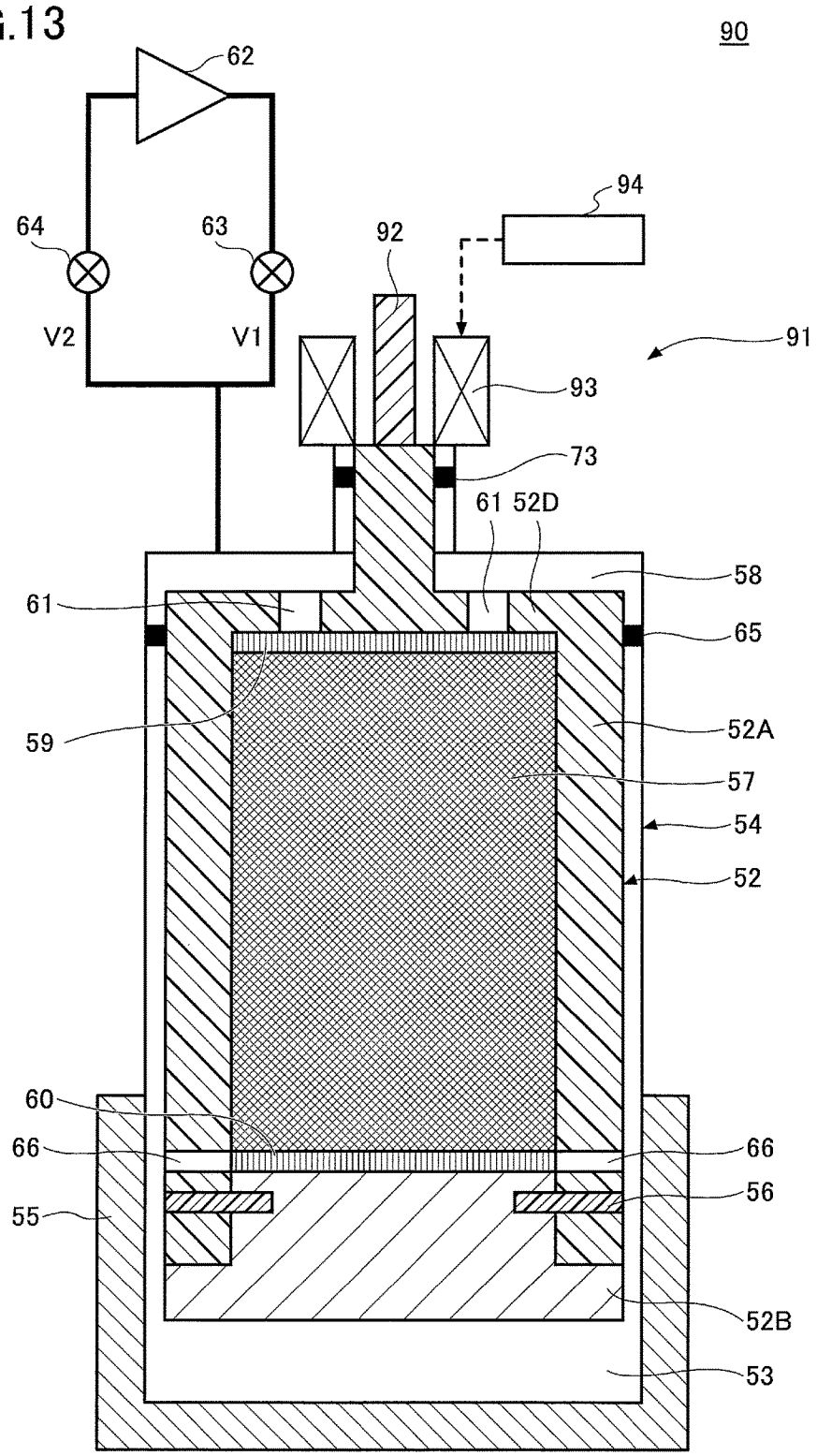
FIG. 13 is an outline configuration diagram of a GM refrigerator of a third embodiment of the present invention.

FIG. 13 shows a GM refrigerator 90 of a third embodiment of the present invention.

Here in FIG. 13, the same numerals are put to components corresponding to those of the GM refrigerator 50 of the second embodiment, and the description is omitted.

The GM refrigerator 90 of the present embodiment features a linear motor as a drive unit 91. This drive unit 91 includes a magnet 92, a drive inductor 93, a control unit 94 and the like.

The magnet 92 is a bar-shaped magnet in which north poles and south poles are magnetized alternately at a predetermined pitch. This magnet 92 is provided at the center part of the top plate part 52D of the displacer 52 so as to protrude upward.

The drive inductor 93 is constituted of plural electromagnets. The respective electromagnets generate magnetic forces by flowing currents therein. The magnet 92 is inserted into a space formed in the center part of the drive inductor 93 movable in a vertical direction. The drive inductor 93 is connected to the control unit 94.

The control unit 94 is to drive and control the drive inductor 93. More specifically, the control unit 94 changes a magnitude and a direction of a current supplying to the drive inductor 93. As discussed above, the magnet 92 is magnetized by the north poles and the south poles alternately at the predetermined pitch. Accordingly, by allowing the control unit 94 to control the magnet poles of the plural electromagnets constituting the drive inductor 93 so as to change subsequently, the magnet 92 moves linearly.

The magnet 92 is fixed to the displacer 52. Hence, by causing the drive inductor 93 to move the magnet 92, the displacer 52 is also moved. Accordingly, the displacer 52 can be driven by the drive unit 91.

The movement of the displacer 52 by the drive unit 91 can be adjusted by controlling the magnitude and direction of the current flowing through the drive inductor 93. In the present embodiment, a micro computer is incorporated in the control unit 94, and a program that is set to cause the displacer 52 to be moved as shown by the solid lines in FIG. 4 is also incorporated.

Therefore, by allowing the control unit 94 to control the drive inductor 93, the displacer 52 is moved as shown by the solid lines in FIG. 4. By doing this, because the moving speeds V1, V2 at the bottom dead center (BDC) of the displacer 52 can be increased similarly to the first embodiment in the present embodiment, a lot of refrigerant gas can be supplied into the GM refrigerator 50 (cylinders 4) efficiently. Accordingly, the lot of refrigerant gas can be expanded in the expansion space 53 in generating a cooling, and the cooling efficiency of the GM refrigerator 90 can be enhanced.

In this manner, according to a cryogenic refrigerator of embodiments of the present invention, a cooling efficiency can be improved because a refrigerant gas can be efficiently supplied into a cylinder in supplying the refrigerant gas.

All examples recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority or inferiority of the invention. Although the embodiments of the present invention have been described in detail, it should be understood that the various changes, substitutions, and alterations could be made hereto without departing from the spirit and scope of the invention.

What is claimed is:

1. A Gifford-McMahon refrigerator comprising:

a compressor having an inlet and an outlet;

a cylinder;

a displacer provided in the cylinder, the displacer defining a room temperature chamber between a top wall of the cylinder and a top surface of the displacer and an expansion space between a bottom wall of the cylinder and a bottom surface of the displacer, wherein the expansion space is surrounded by a cooling stage and is configured to generate a cooling by expanding a refrigerant gas caused by back and forth movement of the displacer;

a drive unit configured to move the displacer back and forth in the cylinder;

an inlet valve provided in a first flow passage connecting the outlet of the compressor with the room temperature chamber and configured to be opened in supplying the refrigerant gas to the room temperature chamber; and an exhaust valve provided in a second flow passage connecting the inlet of the compressor with the room temperature chamber and configured to be opened in returning the refrigerant gas from the room temperature chamber to the compressor, wherein the drive unit includes a drive chamber to allow a driver gas for driving the displacer, a high-pressure valve provided in a supply pipe connecting the outlet of the compressor with the drive chamber and configured to supply the driver gas to the drive chamber by being opened, and a low-pressure valve provided in a return pipe connecting the inlet of the compressor with the drive chamber and configured to return the driver gas from the drive chamber to the compressor, and wherein a first period of time when the low-pressure valve is opened is set longer than a second period of time when the high-pressure valve is opened.

2. The Gifford-McMahon refrigerator as claimed in claim 1, wherein the low-pressure valve is opened after the inlet valve is opened and is closed after the inlet valve is closed.

3. The Gifford-McMahon refrigerator as claimed in claim 2, wherein the exhaust valve is opened after the inlet valve is closed, and the low-pressure valve is closed before the exhaust valve is closed.

4. The Gifford-McMahon refrigerator as claimed in claim 1, wherein the high-pressure valve is opened after the exhaust valve is opened, and is closed after the exhaust valve is closed.

5. The Gifford-McMahon refrigerator as claimed in claim 4, wherein the inlet valve is opened after the exhaust valve is closed, and the high-pressure valve is closed before the inlet valve is closed.

6. The Gifford-McMahon refrigerator as claimed in claim 1, further comprising:

a drive piston integrally formed with the displacer at a high-temperature end of the displacer, the drive chamber being formed between a high-temperature end of the cylinder and the drive piston; and a sealing member provided between the high-temperature end of the cylinder and the drive piston, the sealing member forming the drive chamber and hermetically separating the drive chamber from the room temperature chamber.

7. The Gifford-McMahon refrigerator as claimed in claim 1, wherein a flow passage resistance is provided between the high-pressure valve and the drive chamber.

8. A method of operating a Gifford-McMahon refrigerator, the Gifford-McMahon refrigerator including:

a compressor having an inlet and an outlet;

a cylinder;

a displacer provided in the cylinder, the displacer defining a room temperature chamber between a top wall of the cylinder and a top surface of the displacer and an expansion space between a bottom wall of the cylinder and a bottom surface of the displacer, wherein the expansion space is surrounded by a cooling stage and is configured to generate a cooling by expanding a refrigerant gas caused by back and forth movement of the displacer;

a drive unit configured to move the displacer back and forth in the cylinder;

an inlet valve provided in a first flow passage connecting the outlet of the compressor with the room temperature chamber and configured to be opened in supplying the refrigerant gas to the room temperature chamber; and an exhaust valve provided in a second flow passage connecting the inlet of the compressor with the room temperature chamber and configured to be opened in returning the refrigerant gas from the room temperature chamber to the compressor, wherein the drive unit includes a drive chamber to allow a driver gas for driving the displacer, a high-pressure valve provided in a supply pipe connecting the outlet of the compressor with the drive chamber and configured to supply the driver gas to the drive chamber by being opened, and a low-pressure valve provided in a return pipe connecting the inlet of the compressor with the drive chamber and configured to return the driver gas from the drive chamber to the compressor, the method comprising steps of:

opening the high-pressure valve while closing the low-pressure valve for a first period of time to move the displacer down by setting a first pressure in the room temperature chamber lower than a second pressure in the drive chamber; and opening the low-pressure valve while closing the high-pressure valve for a second period of time that is longer than the first period of time to move the displacer up by setting the first pressure in the room temperature chamber higher than the second pressure in the drive chamber.

9. The method as claimed in claim 8, further comprising step of:

opening the inlet valve; and closing the opened inlet valve, wherein the step of opening the low-pressure valve while closing the high-pressure valve starts after the step of opening the inlet valve and finishes after the step of closing the opened inlet valve.

10. The method as claimed in claim 9, further comprising a step of:

opening the exhaust valve; and closing the opened exhaust valve, wherein the step of opening the exhaust valve is performed after finishing the step of closing the opened inlet valve, and the step of closing the opened exhaust valve finishes after finishing the step of opening the low-pressure valve while closing the high-pressure valve.

11. The method as claimed in claim 8, wherein the step of opening the high-pressure valve while closing the low-pressure valve starts between the steps of opening the exhaust valve and closing the opened exhaust valve, and finishes before finishing the step of closing the opened exhaust valve.

12. The method as claimed in claim 11, wherein the step of opening the inlet valve is performed after finishing the step of closing the opened exhaust valve, and the step of opening the high-pressure valve while closing the low-pressure valve starts before the step of opening the inlet valve.

* * * * *